US005996135A

United States Patent [19]

Hsieh

[11] Patent Number: 5,996,135

[45] Date of Patent: Dec. 7, 1999

[54] WATER-SAVING STRUCTURE OF TOILET BOWL

[76] Inventor: Elvis Hsieh, No.31, 24th Road, Taichung Industrial Park, Taichung, Taiwan

[21] Appl. No.: 09/116,994

[22] Filed: Jul. 17, 1998

[51] Int. Cl.[6] ..... E03D 1/14

[52] U.S. Cl. ..... 4/324; 4/411; 4/412; 4/415

[58] Field of Search ..... 4/405, 411, 412, 4/413, 414, 415, 324, 325

[56] References Cited

U.S. PATENT DOCUMENTS

| | | | |
|---|---|---|---|
| 2,145,601 | 7/1939 | Hopper | 4/67 |
| 3,903,551 | 9/1975 | Johnson | 4/67 |
| 4,837,867 | 6/1989 | Miller | 4/324 |
| 5,836,021 | 11/1998 | Davidson | 4/411 |

*Primary Examiner*—Henry J. Recla
*Assistant Examiner*—Huyen Le
*Attorney, Agent, or Firm*—Rosenberg, Klein & Bilker

[57] ABSTRACT

A water-saving structure of toilet bowl, includes a tube member, a pull knob, a stopper body, a pull cord, a handle and a valve body disposed at a bottom of a water tank of the toilet bowl. When pulling the pull knob, the stopper body is stopped by the tube member and the valve body is pulled open without totally buoying up, permitting a small amount of water to flow out of the water tank so as to save water. Alternatively, the handle can be pressed down to totally pull up the valve body, permitting the water in the water tank to entirely flow out.

5 Claims, 6 Drawing Sheets

WATER-SAVING STRUCTURE OF TOILET BOWL

BACKGROUND OF THE INVENTION

The present invention relates to a water-saving structure of toilet bowl, which has a two-stage flushing structure for selectively flushing the toilet bowl by a small or a large amount of water.

FIG. 1 shows an existing flushing structure of the water tank of toilet bowl, which canonly flush the toilet bowl by fixed amount of water. Once the handle 11 is pressed down, the pull cord 12 is driven to pull open the valve body 13. The buoyancy exerted onto the valve body 13 is greater than the weight thereof so that the valve body 13 will buoy in the water, permitting the water to totally flow out. Therefore, the amount of the flushing water cannot be controlled according to the actual requirement and a lot of water is wasted.

Various types of water-saving toilet bowls (not shown) are commercially available. However, such water-saving toilet bowls have numerous parts which are difficult to assemble and replace. This leads to high price of such water-saving toilet bowls.

SUMMARY OF THE INVENTION

It is therefore a primary object of the present invention to provide a water-saving structure of toilet bowl, in which when pulling a pull knob of the handle, the pull cord is only moved through a short distance and the valve body is pulled open without totally buoying up, permitting a small amount of water to flow out of the water tank. Once the pull knob is released, the valve body will be automatically closed up to shut off the water so as to save water.

It is a further object of the present invention to provide the above water-saving structure which includes less and simplified parts. These parts are applicable to the existing toilet bowl without changing the main structure of the toilet bowl so that the expense is reduced.

According to the above objects, the water-saving structure of the present invention includes a tube member, a pull knob, a stopper body, a pull cord, a handle and a valve body disposed at a bottom of a water tank of the toilet bowl. One end of the tube member is disposed with a bight section connected with a fixing section of the handle. The handle is formed with a through hole. The pull cord is movably passed through the through hole of the handle and the tube member. One end of the pull cord extends out of the through hole of the handle to connect with the pull knob. The other end of the pull cord is connected with the valve body of the water tank. The stopper body is disposed on the pull cord between the tube member and the valve body, permitting the pull cord to be moved only through such a distance that when pulling the pull knob, the stopper body is stopped by the tube member and the valve body is pulled open without totally buoying up, permitting a small amount of water to flow out of the water tank. Alternatively, the handle can be pressed down, making the pull cord totally pull up the valve body to exhaust the water in the water tank.

The present invention can be best understood through the following description and accompanying drawings, wherein:

DETAILED DESCRIPTION OF THE PREFERRED EMBODIMENTS

Figure 1:
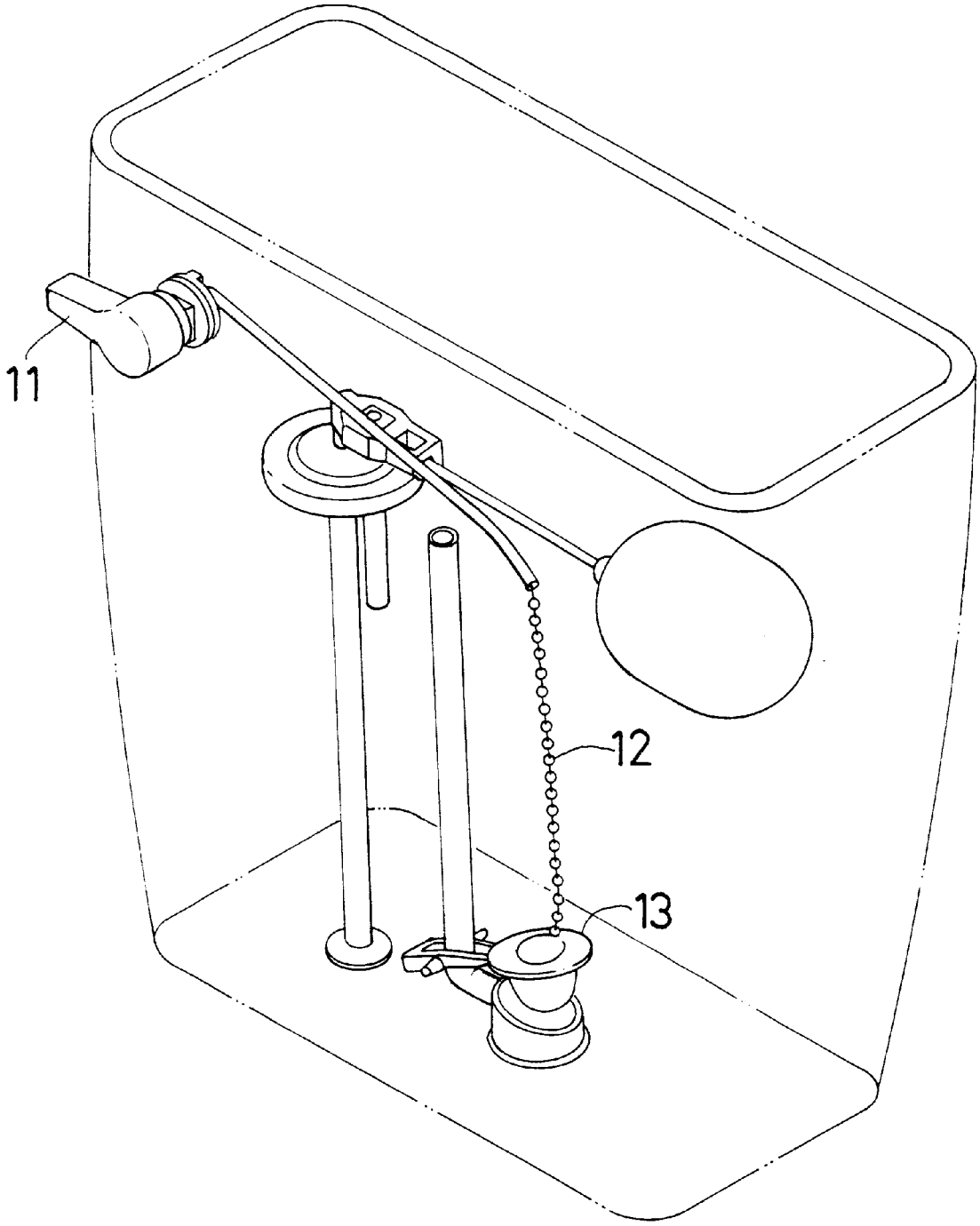
FIG. 1 PRIOR ART
FIG. 1 shows a conventional water tank of toilet bowl.
Figure 2:
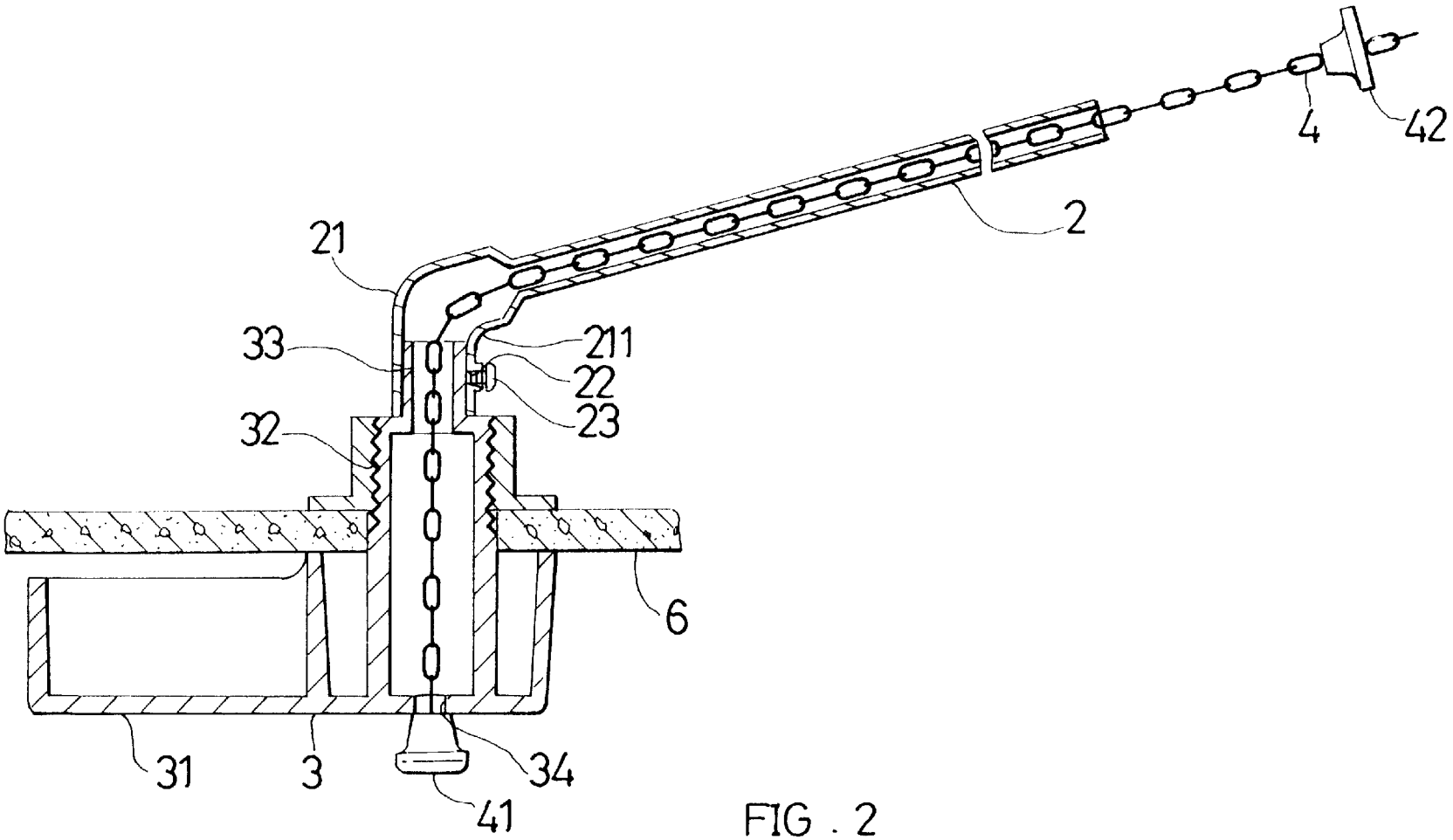
FIG. 2 is a top sectional view of a first embodiment of the present invention.
Figure 3:
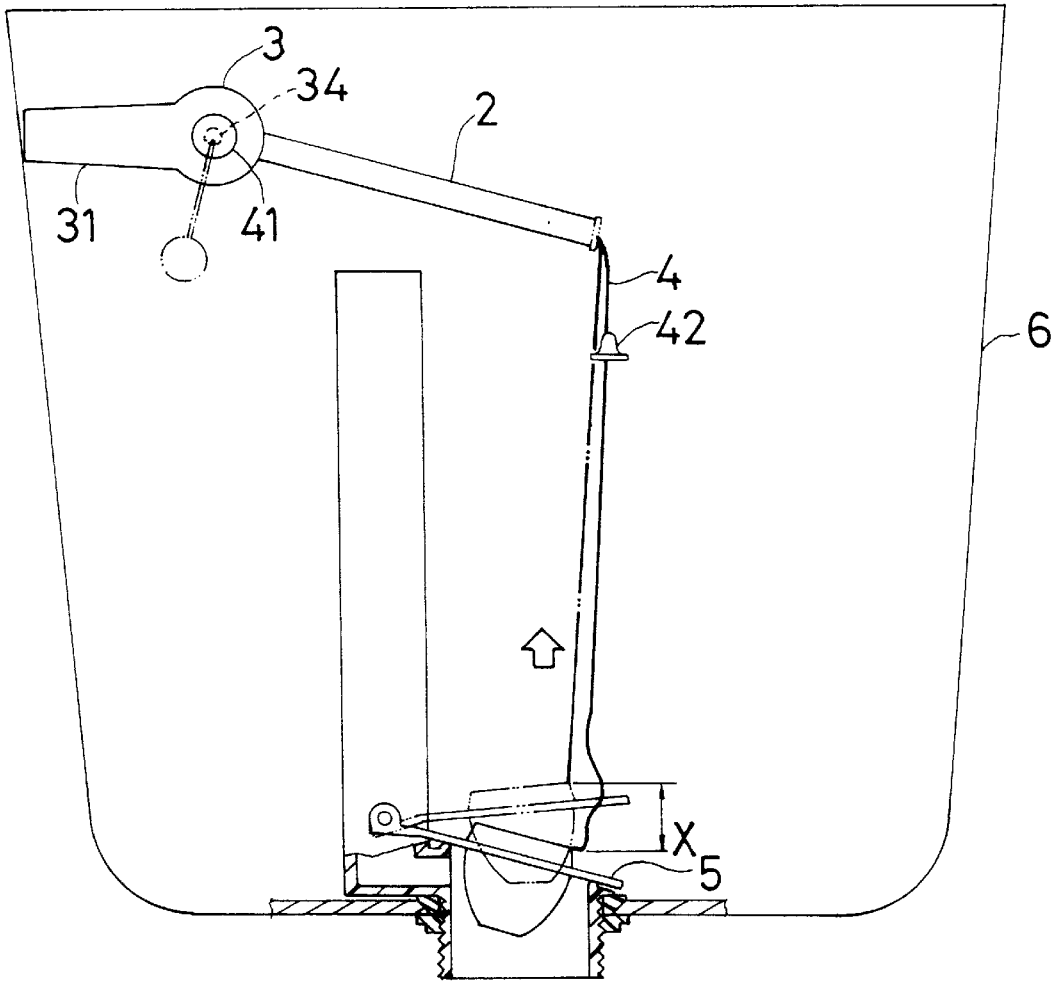
FIG. 3 shows the operation of the first embodiment in a first state.

Please refer to FIGS. 2 and 3 which show a first embodiment of the present invention, including a tube member 2, a handle 3, a pull cord 4, a pull knob 41, a stopper body 42 and a valve body 5 disposed at bottom end of the water tank 6 of the toilet bowl.

One end of the tube member 2 is disposed with a bight section 21. A lateral side 211 of the bight section 21 is formed with a thread hole 22. The bight section 21 is fitted with the handle 3 and locked by a screw 23.

The handle 3 is a cylindrical body positioned on an outer side of the water tank 6. The handle 3 has a transversely extending lever 31. The other end of the handle 3 is disposed with a hollow fixing section 32 having outer thread. A free end of the fixing section 32 has an axially extending hollow coupling section 33 for connecting with the bight section 21 of the tube member 2. The handle 3 is formed with a central through hole 34. The pull cord 4 is passed through the through hole 34 and the tube member 2. One end of the pull cord 4 extends out of the through hole 34 of the handle 3 to connect with the pull knob 41. The other end of the pull cord 4 is connected with the valve body 5 of the water tank. The stopper body 42 is disposed on the pull cord 4 between the tube member 2 and the valve body 5. When pulling the pull knob 41, the stopper body 42 is stopped by the tube member 2, whereby the valve body 5 is pulled open, while failing to buoy up. The stopper body 42 has a weight able to restore the pull cord 4 back to its home position. That is, when releasing the pull knob 41, the pull knob 41 will restore to the position of the handle 3. In addition, when depressing the handle 3, the valve body 5 will buoy up.

Figure 4:
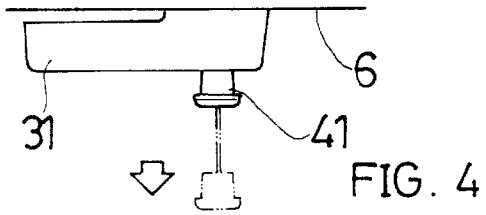
FIG. 4 is a top view showing the pulling operation of the pull knob of the first embodiment.
Figure 5:
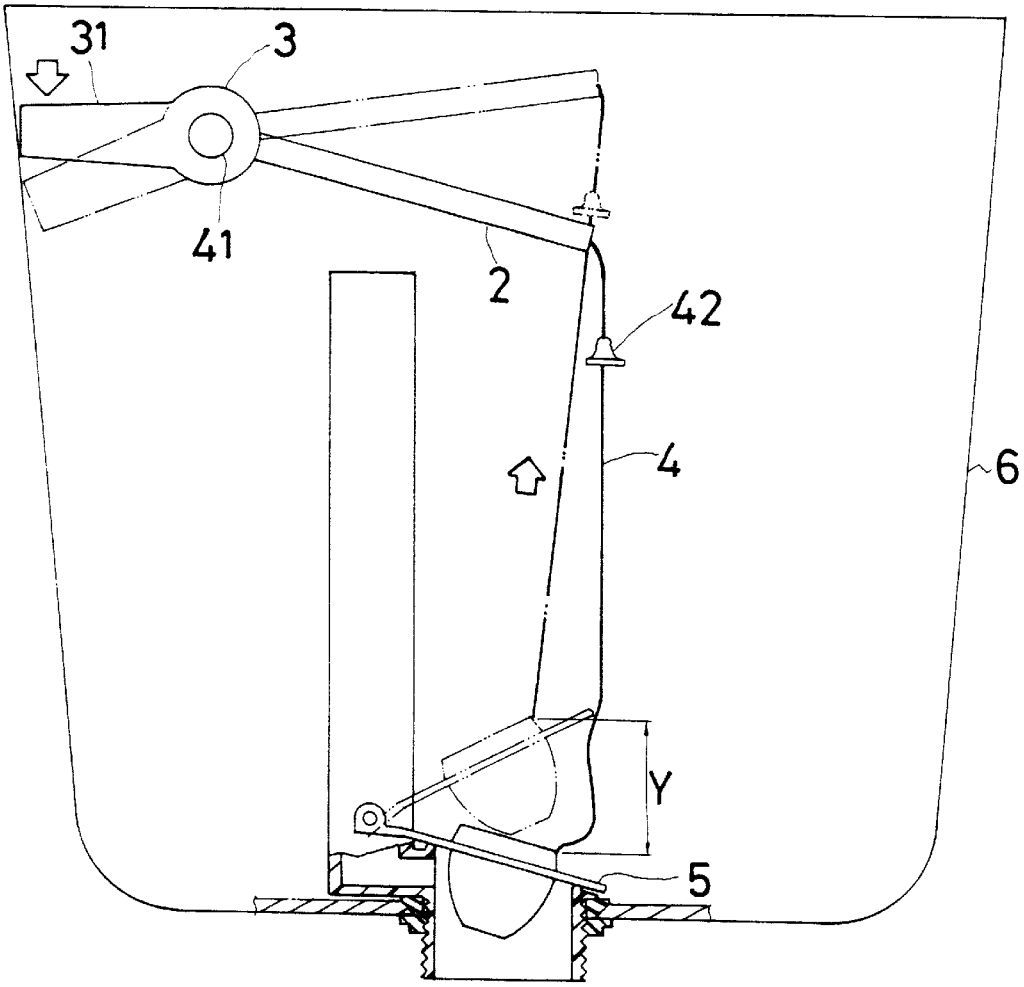
FIG. 5 shows the operation of the first embodiment in a second state.

According to the above arrangement, the amount of the flushing water can be selected in accordance with the actual situation. In the case that a large amount of flushing water is selected, as shown in FIG. 5, the handle 3 is pressed down in a direction of the arrow so as to buoy the valve body 5 in the water. Therefore, the water in the water tank 6 can flow out by the original amount. On the other hand, in the case that only a small amount of water is necessary for flushing, as shown in FIGS. 3 and 4, the pull knob 41 is pulled outward to drive the pull cord 4 to move through a distance X. At this time, the valve body 5 is pulled open but not buoyed up. Therefore, a less amount of water will flow out through the valve body 5. The distance X is shorter than the distance Y through which the pull cord 4 moves when the handle 3 is pressed down so that after the pull knob 41 is released, the valve body 5 is closed to save water.

In use of the present invention, except the tube member 2, handle 3, pull cord 4, pull knob 41 and the stopper body 42, the other parts of the toilet bowl are conventional components. Therefore, it is unnecessary to replace the entire toilet bowl assembly for saving water. Accordingly, the water can be saved in an economical manner.

Figure 7:
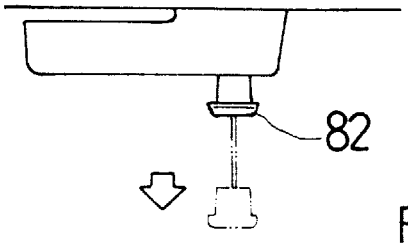
FIG. 7 is a top view showing the pulling operation of the pull knob of the second embodiment.
Figure 6:
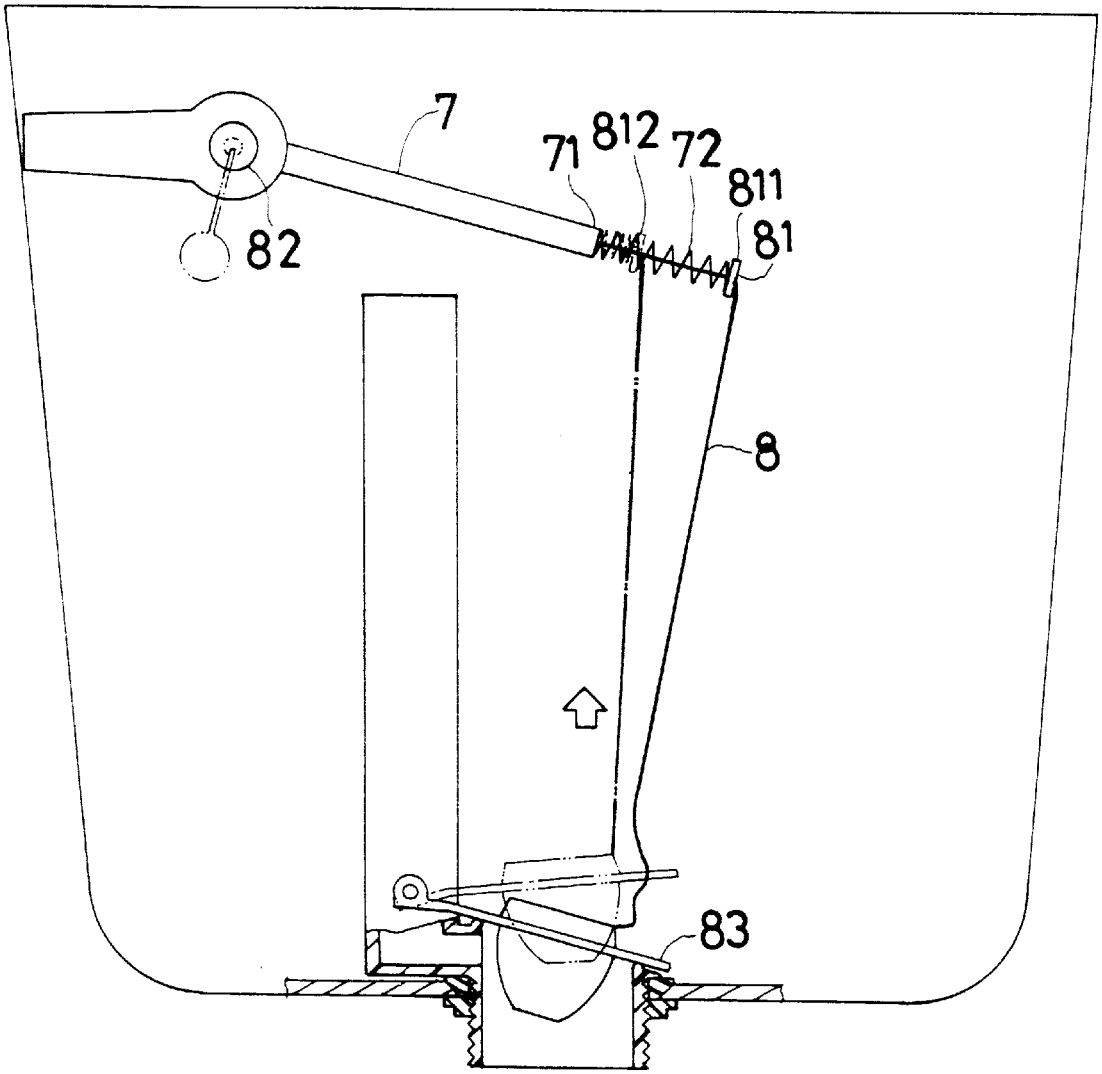
FIG. 6 shows the operation of a second embodiment of the present invention.

FIGS. 6 and 7 show a second embodiment of the present invention, in which the end of a straight section 71 of the tube member 7 is disposed with a spring 72 and the pull cord 8 is disposed with a stopper section 81 which is stopped by the spring 72. When pulling the pull knob 82, the stopper section 81 of the pull cord 8 abuts against the spring 72 to compress the same. At this time, the stopper section 81 moves from a first position 811 to a second position 812 to pull open the valve body 83, permitting the water to flow out. After the pull knob 82 is released, the stopper section 81 moves from the second position back to the first position 811 to close the valve body 83 so as to save water.

Figure 8:
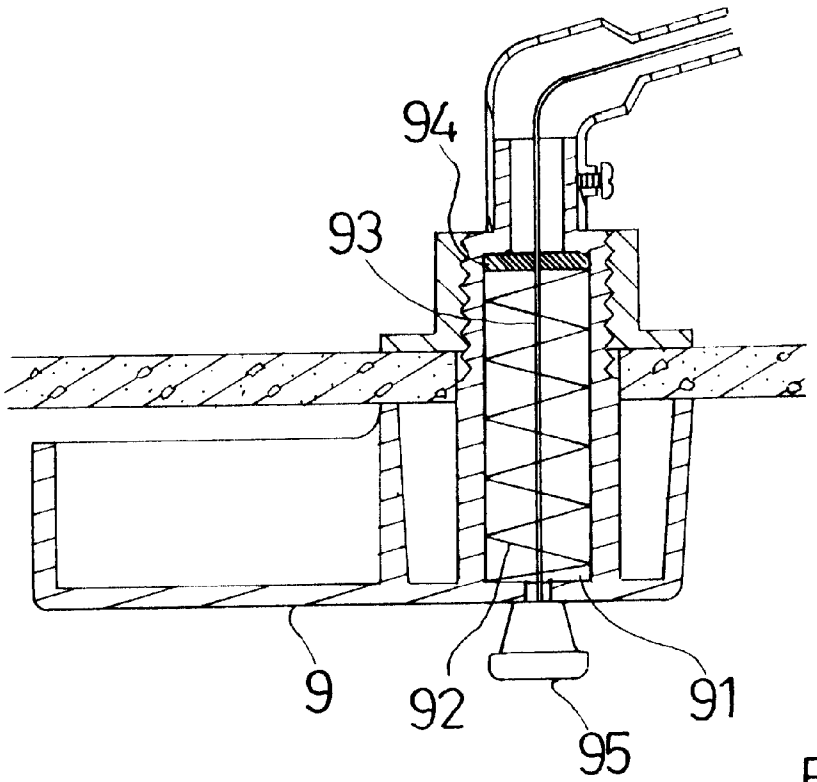
FIG. 8 is a sectional assembled view of a third embodiment of the present invention.

FIG. 8 shows a third embodiment of the present invention, in which a spring 92 is disposed in a central hole 91 of the handle 9 and the pull cord 93 is disposed with a stopper body 94 stopped by the spring 92. When pulling the pull knob 95, the pull knob 95 drives the pull cord 93 and the stopper body 94 compresses the spring 92. According to such arrangement, the water can be also saved. After the pull knob 95 is released, the spring 92 restores the stopper body 94 back to its home position.

It is to be understood that the above description and drawings are only used for illustrating some embodiments of the present invention, not intended to limit the scope thereof. Any variation and derivation from the above description and drawings should be included in the scope of the present invention.

What is claimed is:

1. A water-saving structure of toilet bowl, comprising a tube member, a pull knob, a stopper body, a pull cord, a handle and a valve body disposed at a bottom of a water tank of the toilet bowl, one end of the tube member being disposed with a bight section connected with a fixing section of the handle, the handle being formed with a through hole, the pull cord being movably passed through the through hole of the handle and the tube member, one end of the pull cord extending out of the through hole of the handle to connect with the pull knob, the other end of the pull cord being connected with the valve body of the water tank, the stopper body being disposed on the pull cord between the tube member and the valve body, permitting the pull cord to be moved only through a certain distance, whereby when pulling the pull knob, the stopper body is stopped by the tube member and the valve body is pulled open without totally buoying up, permitting a small amount of water to flow out of the water tank, alternatively, the handle being pressed down, making the pull cord totally pull up the valve body, so that the water in the water tank can entirely flow out.

2. A water-saving structure as claimed in claim 1, wherein the distance through which the pull knob is pulled outward under restriction of the stopper body is shorter than the distance through which the pull cord moves when the handle is pressed down.

3. A water-saving structure as claimed in claim 1, wherein the stopper body has a weight able to restore the pull cord back to its home position.

4. A water-saving structure as claimed in claim 1, wherein one end of the tube member distal from the bight section is disposed with a spring for restoring a stopper section to its home position.

5. A water-saving structure as claimed in claim 1, wherein a spring is disposed in a through hole of the handle and the pull cord is disposed with a stopper body stopped by the spring, whereby when pulling the pull knob, the pull knob drives the pull cord and the stopper body compresses the spring.

* * * * *